United States Patent [19]

Huber

[11] Patent Number: 4,524,465

[45] Date of Patent: Jun. 25, 1985

[54] SAFETY HELMET, ESPECIALLY FOR MOTORCYCLISTS

[75] Inventor: Siegfried Huber, Munich, Fed. Rep. of Germany

[73] Assignee: Bayerische Motoren Werke AG, Fed. Rep. of Germany

[21] Appl. No.: 515,899

[22] Filed: Jul. 21, 1983

[30] Foreign Application Priority Data

Jul. 22, 1982 [DE] Fed. Rep. of Germany ..... 3227410

[51] Int. Cl.[3] ..... A42B 1/08

[52] U.S. Cl. ..... 2/424; 2/425; 2/428; 2/436

[58] Field of Search ..... 2/424, 410, 425, 427, 2/428, 429, 430, 435, 436, 437, 6, 9

[56] References Cited

FOREIGN PATENT DOCUMENTS

| | | | |
|---|---|---|---|
| 0079313 | 5/1983 | European Pat. Off. | 2/425 |
| 7611248 | 4/1977 | Netherlands | 2/424 |
| 1576647 | 10/1980 | United Kingdom | 2/424 |
| 2088696 | 6/1982 | United Kingdom | 2/425 |

*Primary Examiner*—Louis K. Rimrodt
*Assistant Examiner*—J. L. Kravitz
*Attorney, Agent, or Firm*—Craig and Burns

[57] ABSTRACT

A safety helmet exhibits, in the zone of the longitudinal line of symmetry of its chin protector, an upwardly projecting rubber-elastic material air duct member comprising a sealing lip. This sealing lip extends past the contact area of the visor on the chin protector to such an extent that the chin protector is in contact with the visor when the visor is opened a crack. Thus, the air stream entering the interior of the helmet is conducted toward the lateral regions of the window and cannot affect the eyes of the helmet wearer. Since the air duct member is made of a rubber-elastic material, the visor can be closed entirely. Additionally, the air duct member is provided with two lateral parts and a continuous water-conducting groove which is arranged in these parts and in the air duct member. Water can collect in the groove and be drained off in the rearward and downward directions.

10 Claims, 6 Drawing Figures

SAFETY HELMET, ESPECIALLY FOR MOTORCYCLISTS

BACKGROUND OF THE INVENTION

The invention relates to a safety helmet having an air duct member. When the visor of a conventional safety helmet is brought into tight contact with the marginal zone of the visor opening, the inside of the visor may fog up at low outside temperatures due to the almost airtight interior of the helmet, thus considerably impairing the vision of the driver. It is possible to avoid this problem in the conventional safety helmet by opening the visor a crack, for example, by projecting its bottom marginal zone about 15 millimeters from the outer skin of the helmet, thus allowing circulating air to enter the interior of the helmet. Disadvantageously, the highest pressure head is produced at the bottom-positioned, central marginal zone of the visor. Therefore, a crack-wide opening of the visor disadvantageously sends the incoming air stream into the face of the helmet wearer, particularly the eyes. This incoming air stream may lead to tearing of the eyes and eye irritation of the helmet wearer. Additionally, the incoming air stream has the disadvantageous effect of fogging up the inside of the visor with the splash water resulting from the air entering under high pressure.

The safety helmet disclosed in German utility model No. 7,837,986 has a flat air-conducting member which extends from the chin protector obliquely into the interior of the helmet wearer. The free end of the air-conducting member lies in the vision field of the visor. Because the air-conducting member has an outer contour corresponding approximately to the mouth and nose portion of the helmet wearer, this air-conducting member can merely avoid, if anything, a fogging of the inside of the visor with breathing air. However, because such air can spread within the entire interior of the helmet, the air-conducting member does not entirely prevent fogging of the inside of the visor, especially at low temperatures.

SUMMARY OF THE INVENTION

Therefore, it is an object of the present invention to provide a safety helmet having an air duct member wherein the visor of the safety helmet, to avoid moisture precipitation, can be opened a crack on its inside. Another object of the present invention is to provide a safety helmet that does not expose the eye region of the helmet wearer to a draft when the visor is cracked open, yet can be entirely closed without any problems. Yet another object of the present invention is to provide a safety helmet in which water is prevented from entering the interior of the helmet.

A feature of the present invention is to provide a safety helmet having a pivotably mounted visor wherein an upwardly projecting air duct member, of a rubber-elastic material, is provided at the center of the chin protector of the helmet.

By means of the air duct member fashioned and arranged in accordance with this invention, the visor, when its bottom marginal zone is in contact with the air duct member, can be opened a crack, wherein the bottom zone is approximately 15 millimeters from the outer skin of the helmet and, moisture precipitation is precluded from forming on the inside of the visor by entering air. Advantageously, the dammed-up air is conducted, by means of the air duct member, past this air duct member on both sides toward the lateral zones of the visor. Thereby, the region of the helmet wearer's eyes is not exposed to air, especially since the entering air, flowing as described above, has a comparatively lower speed.

A further feature in accordance with the present invention is that the air duct member is preferably formed of a rubber-elastic material. Thus, the air duct member can be displaced inwardly with a very small force so that the visor, if desired, can be entirely closed. Additionally, air flowing into the interior of the helmet on both sides of the air duct member circulates in the interior for a short time, thereby contributing to prevent a fogging on the inside of the visor, by the vacuum ambient at that location or toward the bottom side of the safety helmet.

A very flush contact of the air duct member against the visor is attained by providing a sealing lip oriented toward the bottom positioned rim of the visor. Since the sealing lip is very flexible, it can be displaced inwardly with a very small expenditure of force, namely by swinging the visor downwardly.

The minor frictional contact which exists between the visor and the air duct member when the latter is displaced inwardly, can even be further reduced by providing the sealing lip with flocks of velour.

Another feature of the present invention is that water that may be present at the upper edge zone of the chin protecter can collect in the water-conducting groove provided at the air duct member and the lateral parts. Thus, the water, while prevented from entering the interior of the helmet, can be drained in the downward direction by way of the rearward edge zones of the chin protector.

BRIEF DESCRIPTION OF THE DRAWINGS

These and other objects, features, and advantages of the present invention will become more apparent from the following description when taken in connection with the accompanying drawings which show, for the purposes of illustration only, several embodiments in accordance with the present invention, and wherein.

DETAILED DESCRIPTION OF THE INVENTION

Figure 1:
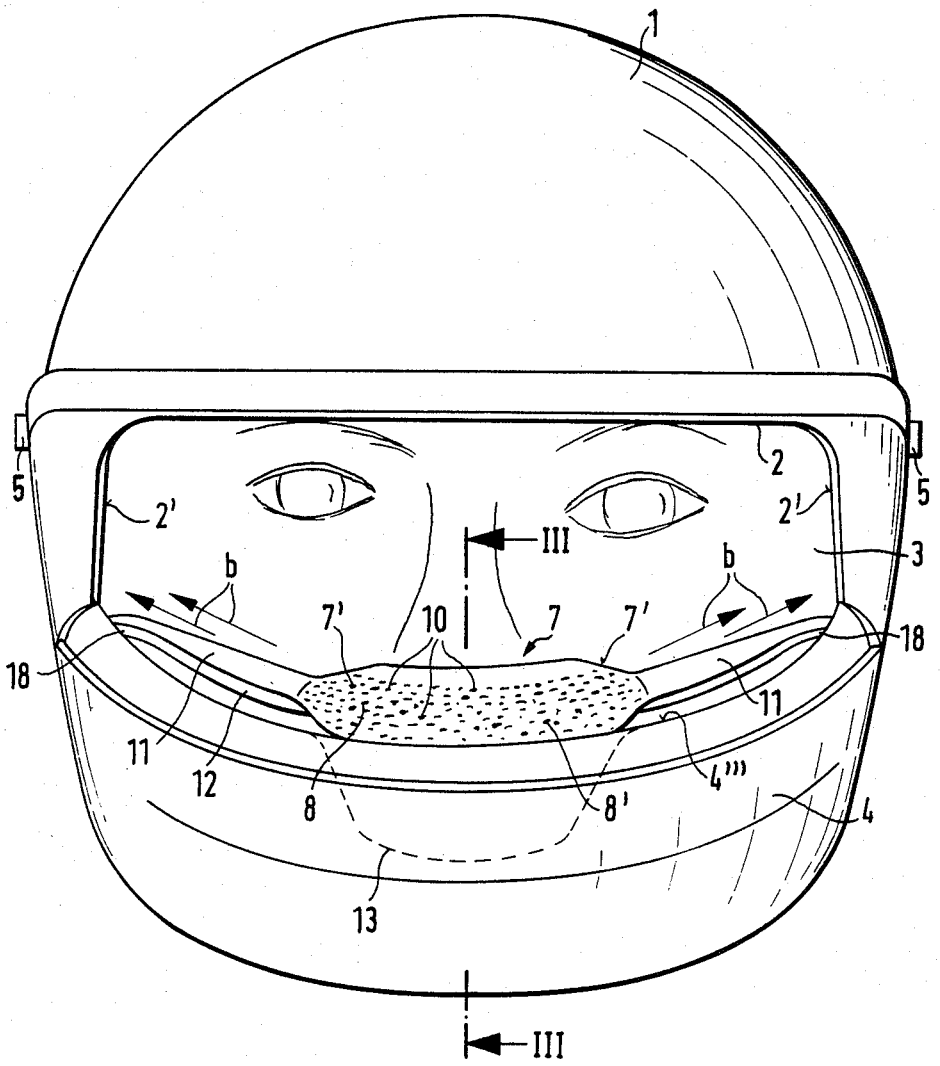
FIG. 1 shows a safety helmet in frontal view.
Figure 2:
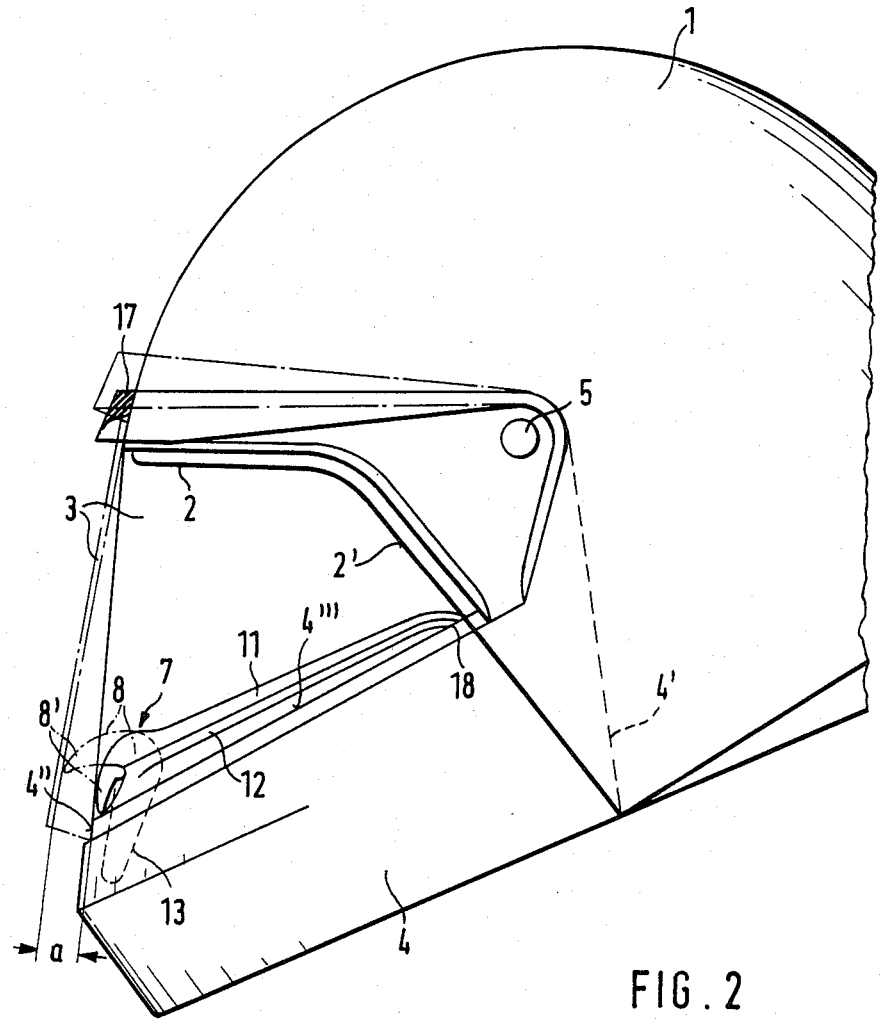
FIG. 2 shows a lateral view of FIG. 1.

The motorcycle safety helmet 1 illustrated in FIGS. 1 and 2 has a viewing opening which can be covered by a visor 3. The visor 3 is mounted, together with a chin protector 4, on two opposed bearing pins 5 by the lateral articulating elements 4' of the chin protector 4 to be pivotable upwards and downwards relative to the safety helmet 1. By the combined articulation of the chin protector 4 and the visor 3, the visor 3 can be pivoted either independently of or together with the chin protector 4. In contrast thereto, when the chin protector 4 is swung upwardly, the visor 3 is also displaced with the chin protector 4. However, if the chin protector 4 is rigid the visor 3 can be mounted to be pivotable as usual.

Figure 3:
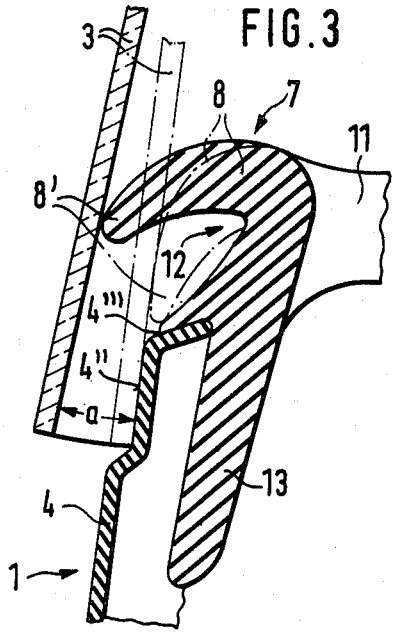
FIG. 3 is a section along line III—III in FIG. 1 on an enlarged scale with the visor being opened a crack.

An air duct member 7 projects upwardly from the upper edge 4''' of the chin protector 4. The air duct member 7 is provided in the central zone of the longitudinal extension of the chin protector, i.e. in the region of the plane of symmetry of the safety helmet 1. The air duct member 7 is preferably formed of a conventional soft, rubber-elastic material. As illustrated in FIGS. 2 and 3, the air duct member 7 comprises a sealing lip 8 formed along an edge zone, in accordance with the embodiment illustrated in FIG. 3, the sealing lip 8 has a crescent-like cross-sectional profile, the free end section 8' thereof being oriented toward the bottom edge of the visor 3. When the visor 3 is opened a crack, the bottom edge of the visor 3 projects from its contact surface 4'' at the chin protector 4 amounting to about 15 millimeters. This is shown in FIG. 2 by dot-dash lines and in FIGS. 3–5 by solid lines. The sealing lip 8 of FIG. 3 or the sealing lip 9 formed along the edge zone of the air duct member 7 of FIG. 4 projects past the contact surface 4'' of the visor 3 on the chin protector 4 to such an extent that either its free end section 8' or its frontal side 9' is in intimate contact with the visor 3.

Figure 4:
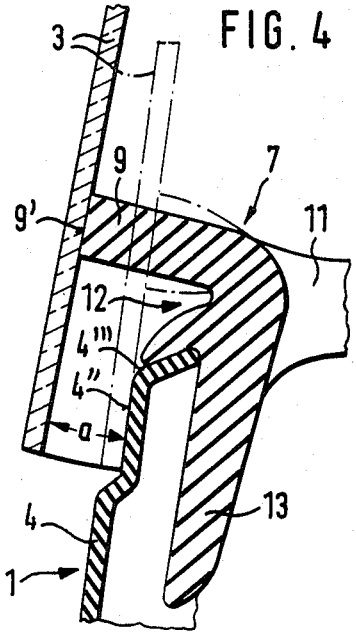
FIG. 4 shows a modified embodiment of an air duct member in a sectional view.

FIG. 4 illustrates an embodiment of a sealing lip 9 which has an approximately angular cross-sectional profile with a rectangular frontal side 9' facing the visor 3 and flatly contacting the visor 3 when the visor 3 is opened a crack. The topside of the free end section 8' of the sealing lip 8 and the frontal side 9' of the sealing lip 9, cooperating with the visor 3, is provided with flocks of velour 10. Thereby, a very small frictional resistance is produced in the cooperation between visor 3 and sealing lip 8, 9. As can be seen from FIG. 1, the longitudinal extension of the sealing lip 8 and 9, respectively, is about one-third of the logitudinal extension of the chin protector 4.

FIGS. 1 and 2 show that two lateral parts 11 adjoin the air duct member 7. These lateral parts 11 extend up to the end zones of the chin protector 4, i.e. up to the lateral edges 2' of the viewing opening 2. A continuous water-conducting groove 12, open toward the visor 3, is molded in the air duct member 7, as well as in the lateral parts 11. The water conducting groove 12 terminates downwardly at the free ends of the lateral parts 11 facing the lateral edges 2' of the window 2. The lateral parts 11 taper in their height in a wedge-shaped fashion starting with the air duct member 7 up to their free ends. Finally, the air duct member 7 comprises a downwardly projecting extension 13 which serves to accommodate a microphone or the like and is about twice as high as the air duct member 7. A one-piece replacement part, including the air duct member 7, the two lateral parts 11, and the extension 13, can be manufactured economically by the expansion or injection-molding method. The one-piece replacement part can be attached to the chin protector 4 by either an adhesive or a clamping connection.

Figure 5:
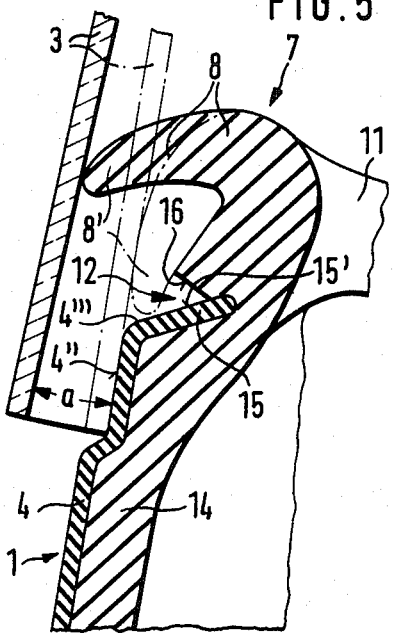
FIG. 5 shows a sectional view in the zone of the plane of symmetry of the helmet of an air duct member formed at the lining of a chin protector.
Figure 6:
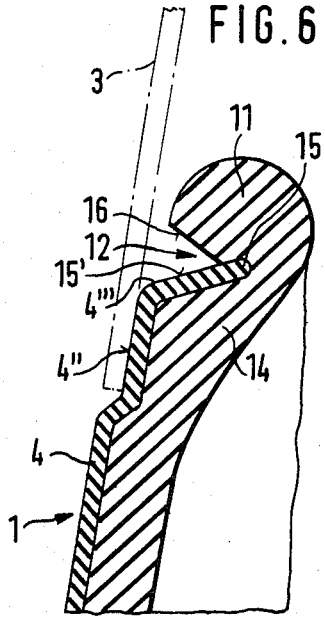
FIG. 6 is a section in the lateral zone of the chin protector showing a lateral part formed at the lining.

As can be seen from FIGS. 5 and 6, the air duct member 7 and the lateral parts 11 can also be fashioned integrally at the lining 14 of the chin protector 4. In this case, the lining 14 is fixed in place by an inwardly pointing angled portion 15 provided at the chin protector 4, and is glued to this angled portion 15. A continuous bevel 16 is provided at the externally disposed edge zone of the lining 14. This continuous bevel 16 cooperates with the topside 15' of the angled portion 15, alongside the air duct member 7 and the lateral parts 11. The bevel 16 and the topside 15' of the angled portion 15 form the water-conducting groove 12. Since the air duct member 7 and the lateral parts 11 cover the interiorly disposed end face of the angled portion 15, they constitute an edge protection for the angled portion 15.

The visor 3 has a gasket 17 on its side at its edge zone at the topside, which seals the visor 3 with respect to the safety helmet 1, even when the visor 3 is opened a crack. Due to the vacuum ambient at the topside of the visor 3, however, the air entering the interior of the helmet 1 as described above is partially exhausted.

The air duct member 7 provided in accordance with the invention cooperates with the visor 3 in the following manner. When the visor 3 is opened a crack, thus projecting by the dimension a, from the contact surface 4'' at the chin protector 4, the visor 3 is in contact with the sealing lip 8 or 9 of the air duct member 7. Thus the air flow, which is very vigorous especially in the center of the helmet, is conducted past the two lateral, oblique faces 7' of the air duct member 7. These faces 7' extend convergingly in the upward direction, and into the interior of the helmet. During this process, the entering air stream, schematically indicated by the arrows b in FIG. 1, is conducted toward the lateral zones of the viewing opening 2 so that the air stream b does not affect the eye zone of the helmet wearer in a way deleterious to his or her health. The entering air stream b, thus prevents fogging of the inside of the visor 3. Furthermore, the air duct member 7 deflects the air stream b entering the interior of the helmet thereby causing a decrease in the speed of the air stream b. During this process, the water to which the chin protector 4 is exposed can collect in the waterconducting groove 12 formed at the air duct member 7 and at the lateral parts 11 and can drain off by the rearward edge zone of the chin protector 4. Accordingly, the water does not enter the interior of the helmet 1.

Since the air duct member 7 is made of a very elastic rubber, the visor 3 can be closed completely, if need be, with a minor expenditure of force, practically without additional force. In this connection, the free end section 8' of the sealing lip 8 is displaced with the formation of a rolling motion downwardly. Similarly the frontal side 9' of the sealing lip 9 is displaced inwardly with the compression of the rubber-elastic material or with a pivotal motion, as illustrated in dot-dash lines in FIGS. 3 and 4. The water-conducting groove 12 is covered in the zone of the air duct member 7 by the free end section 8' of the sealing lip 8 during this process. While the visor 3 is being opened, the sealing lip 8 or 9 of the air duct member 7 resiliently springs toward the outside again due to its inherent tension.

While I have shown and described several embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

What is claimed is:

1. A safety helmet having a viewing opening comprising pivotably mounted visor means for the viewing opening, a chin protector, and an air duct member disposed generally in the center of the chin protector of the helmet, said air duct member projecting upwardly from an upper rim of the chin protector, the air duct member being formed from an elastomeric material and having an edge zone facing the visor means, said edge zone being adapted to project past the contact area of the visor means at the chin protector whereby the air duct member is in intimate contact with the visor when the visor is opened a crack.

2. The safety helmet according to claim 1, wherein the air duct member includes a sealing lip having a crescent-shaped cross-sectional profile, a free end section of the sealing lip being oriented toward a bottom-positioned rim of the visor means.

3. The safety helmet according to claim 1, wherein the air duct member includes a sealing lip with a frontal side facing the visor means, the frontal side contacting the visor means flush when the visor means is opened a crack.

4. The safety helmet according to claim 2 or 3, wherein the width of the sealing lip equal is generally about one-third of the width of the chin protector.

5. The safety helmet according to claim 2 or 3, wherein the side of the sealing lip cooperating with the visor means is provided with flocks of velour.

6. The safety helmet according to claim 1, wherein the air duct member includes two lateral parts, each extending up to end zones of the chin protector, a continuous water-conducting groove open toward the visor means being formed in these lateral parts, wherein the groove emanates from the air duct member.

7. The safety helmet according to claim 6, wherein the water-conducting groove terminates in the downward direction at the free ends of the lateral parts.

8. The safety helmet according to claim 1 or 6, wherein the air duct member includes a downwardly projecting extension.

9. The safety helmet according to claim 6, wherein the air duct member and the lateral parts are formed integrally with the lining of the chin protector.

10. The safety helmet according to claim 9, wherein the chin protector includes an inwardly directed angled portion for fixing the lining in place, the integrally formed air duct member including a surface cooperating with the angled portion thereby forming a water-conducting groove.

* * * * *